US005174121A

United States Patent [19]

Miller

[11] Patent Number: 5,174,121

[45] Date of Patent: Dec. 29, 1992

[54] PURIFIED LIQUID STORAGE RECEPTACLE AND A HEAT TRANSFER ASSEMBLY AND METHOD OF HEAT TRANSFER

[75] Inventor: Steven L. Miller, Shelbyville, Ky.

[73] Assignee: Environmental Water Technology, Louisville, Ky.

[21] Appl. No.: 762,448

[22] Filed: Sep. 19, 1991

[51] Int. Cl.[5] ..... F28D 15/00

[52] U.S. Cl. ..... 62/3.7; 165/104.21; 361/385; 62/259.2

[58] Field of Search ..... 62/3.2, 3.3, 3.6, 3.62, 62/3.64, 3.7, 259.2, 451; 361/385; 165/104.21

[56] References Cited

U.S. PATENT DOCUMENTS 2,835,480 5/1958 Perez ..... 165/104.21
3,008,300 11/1961 Ryan et al. ..... 62/3.3
3,064,440 11/1962 Waller ..... 62/3.3 X
3,269,875 8/1966 White ..... 165/104.21 X
3,433,929 3/1969 Snelling ..... 165/104.21 X
3,815,575 6/1974 Danis ..... 126/390
4,449,578 5/1984 Munekawa ..... 165/104.33
4,602,679 7/1986 Edelstein et al. ..... 165/104.26

*Primary Examiner*—Albert J. Makay
*Assistant Examiner*—William C. Doerrler

[57] ABSTRACT

A heat transfer apparatus and method of regulating temperature in a liquid storage receptacle wherein heat is transferred relative the storage receptacle through an enclosed passageway held at a preselect pressure and containing a vaporizable and condensible fluid medium to uniformly and adiabatically transfer heat to an extended conductive surface to bring the conductive surface in isothermic condition and in cooperative relation with a flow-through heat exchanger.

36 Claims, 2 Drawing Sheets

PURIFIED LIQUID STORAGE RECEPTACLE AND A HEAT TRANSFER ASSEMBLY AND METHOD OF HEAT TRANSFER

BACKGROUND OF THE INVENTION

The present invention relates to a storage receptacle for purified liquids and more particularly to a novel heat transfer assembly and method for transferring heat in various structures such as a liquid storage receptacle containing purified liquids.

Various types of liquid storage receptacles combined with structures and methods for altering the temperatures of the liquids received in the liquid receptacle are known in the art of liquid purification. In this regard, attention is directed to recently issued U.S. Pat. No. 5,017,284, issued to S. L. Miller et al on May 21, 1991. FIGS. 21 and 22 of this patent teach a novel liquid receiving, insulated storage receptacle having an aluminum plate with the cold side of a thermoelectric module connected to the plate to chill liquid received in the storage receptacle and the hot side thereof connected to a heat exchange unit. Attention further is directed to U.S. Pat. No. 4,399,541, issued to Kovats et al on Aug. 16, 1983, which teaches a Peltier device for temperature control of a laser and to U.S. Pat. Nos. 4,548,259, issued to S. Tezuka et al on Oct. 28, 1985 and to U.S. Pat. No. 4,584,061, issued to R. E. Shelton on Apr. 22, 1986, both of which patents teach Peltier devices associated with liquid receptacles through heat exchange devices.

In accordance with the present invention, an improved and novel apparatus and method of accomplishing cooling and heating liquid in a storage receptacle of a liquid purification system such as that disclosed in the abovementioned U.S. Pat. No. 5,017,284 is provided. The apparatus and method of the present invention are not only straightforward, efficient and economical in manufacture and assembly, but in addition, involve a minimum of required space occupying structural parts and a minimum of method steps to accomplish rapid isothermic heat transference with an optimum usage of energy and a maximized heat transfer capability. In addition, the present invention provides a novel heat exchange assembly and a method of transferring heat in a structure which includes the provision of an extended isothermic thermally conductive surface in conjunction with a heat pipe and heat exchanger assembly, the assembly and method requiring a minimum of parts and a minimum of steps and at the same time being straightforward and efficient in manufacture and assembly with an optimum of energy usage during operations.

Various other features of the present invention will become obvious to one skilled in the art upon reading the disclosure set forth herein.

BRIEF SUMMARY OF THE INVENTION

More particularly, the present invention provides a liquid storage receptacle for a liquid purification system comprising: liquid plenum storage means adapted to receive and store liquids therein; thermoelectric module means including two differing electrical conductors to provide hot and cold sides with one side thereof thermally cooperative with the liquid plenum to regulate the temperature of liquid stored therein; and, a heat transfer means cooperative with the other side of the thermoelectric module means, the heat transfer means including a thermally conductive surface having an enclosed extended passage conductively cooperative therewith, the enclosed extended passage including a fluid medium disposed therein at a preselected pressure to be alternatively vaporized and condensed to uniformly and adiabatically transfer the heat from the other side of the thermoelectric module to the conductive surface to bring it to an isothermic condition; and, a heat exchange means having a heat exchange barrier cooperative with the isothermic temperature conductive surface to transfer the heat on one side of the heat exchange barrier to the other side of the barrier. Further, the present invention provides a novel heat transfer assembly which includes an extended conductive surface incorporating an enclosed extended passage therein with a fluid disposed therein at a preselected pressure to be alternatively vaporized and condensed to uniformly and adiabatically transfer heat to the extended conductive surface to bring it to an isothermic condition. In addition, the present invention provides a novel heat transfer method comprising: regulating heat in a first zone; transferring heat from the first zone to a second zone through alternative expansion and condensation of a preselected medium in an enclosed passageway maintained at a preselected pressure to uniformly and adiabatically transfer the heat to the second zone to bring the second zone to an isothermic condition; and transferring the heat from the isothermic zone to a third zone.

It is to be understood that various changes can be made by one skilled in the art in one or more of the several parts of the apparatus disclosed herein and in one more of the several steps of the disclosed novel method without departing from the scope or spirit of the present invention.

BRIEF DESCRIPTION OF THE DRAWINGS

Referring to the drawings which disclose one advantageous embodiment of the present invention.

DETAILED DESCRIPTION OF THE DRAWINGS

Figure 1:
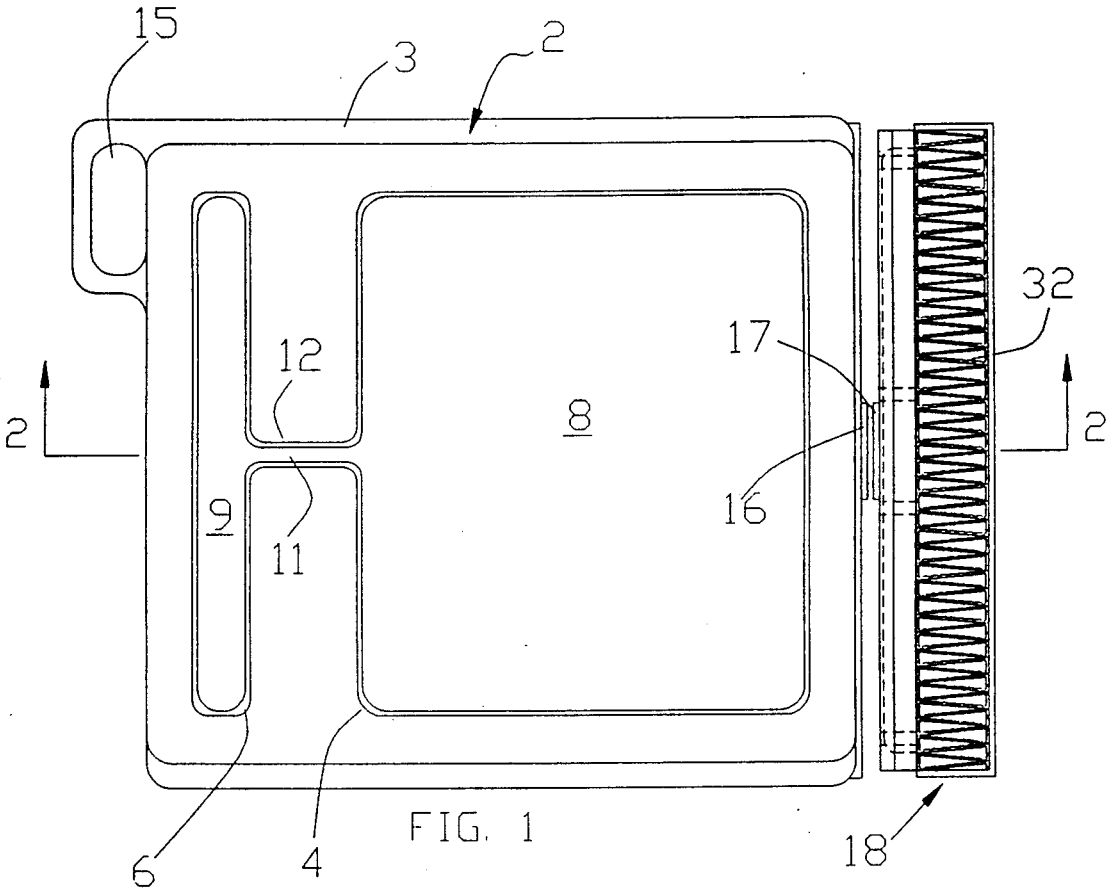
FIG. 1 is a schematic plan view of a typical liquid receiving storage receptacle incorporating a bag assembly and having a conductive plate extending therethrough to include a turned portion with which the novel heat transfer assembly is cooperative.
Figure 2:
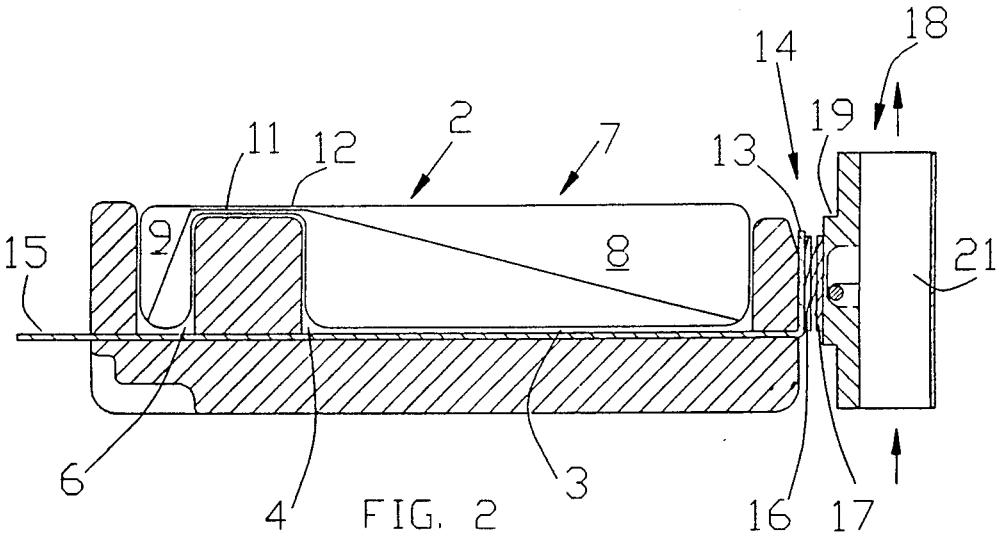
FIG. 2 is a schematic cross-sectional side view of the storage receptacle of FIG. 1 taken in a plane through line 2-2 of FIG. 1, further disclosing the novel heat transfer assembly connected to the turned portion of the conductive plate extending through the storage receptacle.

Referring to FIGS. 1 and 2 of the drawings, a liquid receiving appropriately insulated, storage receptacle 2 is disclosed similar to that set forth in abovementioned U.S. Pat. No. 5,017,284 with a conductive plate 3, advantageously of aluminum extending therethrough below communicating cold and hot compartments 4 and 6 respectively. Each of the compartments 4 and 6 serves to receive and hold a portion of a unified liquid receiving storage bag 7 therein with larger portion 8 being disposed in cold compartment 4 and smaller portion 9, being disposed in hot compartment 6. Portions 8 and 9 are connected by throat section 11 disposed in connection channel 12. The storage receptacle 2 aforedescribed substantially conforms with that of U.S. Pat. No. 5,017,284 and further details thereof are not set forth herein. It is to be noted that conductive plate 3 can even include a gripping handle 15. In U.S. Pat. No. 5,017,284, the cold side of a thermoelectric couple of the Peltier type is disclosed as connected to the undersurface of the conductive plate with a heat exchange unit depending from the hot side thereof.

In accordance with the disclosed embodiment of the invention of FIG. 2, a unique space saving structure is employed with one extreme portion 13 of conductive plate 3 extending through storage receptacle 2 and turned upwardly at a right angle, to face an outer insulated side of receptacle 2 and to thermally and conductively support thermoelectric module 14 through which an electric current is passed and including cold and hot sides 16 and 17 respectively, with the cold side 16 connected to right angle portion 13 and the hot side 17 connected to the inventive heat transfer assembly 18. It is to be understood that the present invention is not to be considered as limited to the particular two compartment bag containing liquid storage receptacle as shown, but that storage receptacles of any one of a number of different geometric configurations and insulative arrangements with differently located and differently sized thermally conductive plate members can be utilized. Also, it is to be understood that a number of different thermoelectric modules can be used, the modules being made from different semiconductor materials, heavily doped to create an excess and deficiency of electrons with the heat absorbed at the cold junction or side 16 being pumped to the hot junction or side 17 in a manner known in the Peltier thermocouple art at a rate proportional to the carrier current passing through the circuit and to the number of couples employed.

Figure 5:
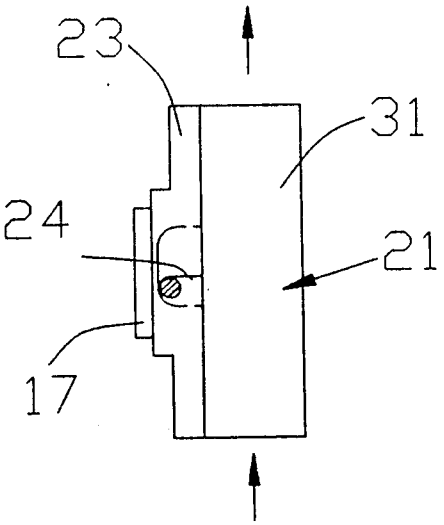
Figure 4:
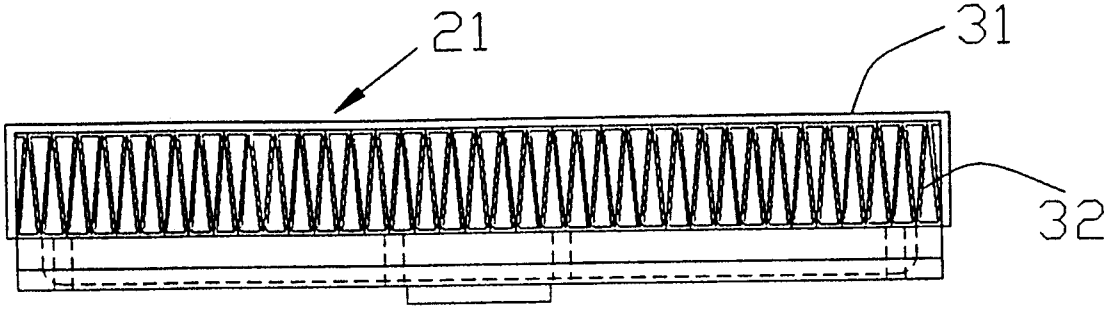
FIG. 4 is a top view of the heat transfer assembly of FIGS. 2 and 3, disclosing in phantom the longitudinally extending enclosed passageway in the longitudinally extending thermally conductive plate and the flow-through heat exchange unit associated with the isothermic conductive plate; and, FIG. 5 is a side view of the heat transfer assembly of FIGS. 3 and 4 disclosing in phantom a cross-section of the longitudinally extending enclosed passageway in the thermally conductive plate and a side view of the flow-through heat exchange unit with flow arrows indicating the selected direction of flow through the heat exchanger.
Figure 3:
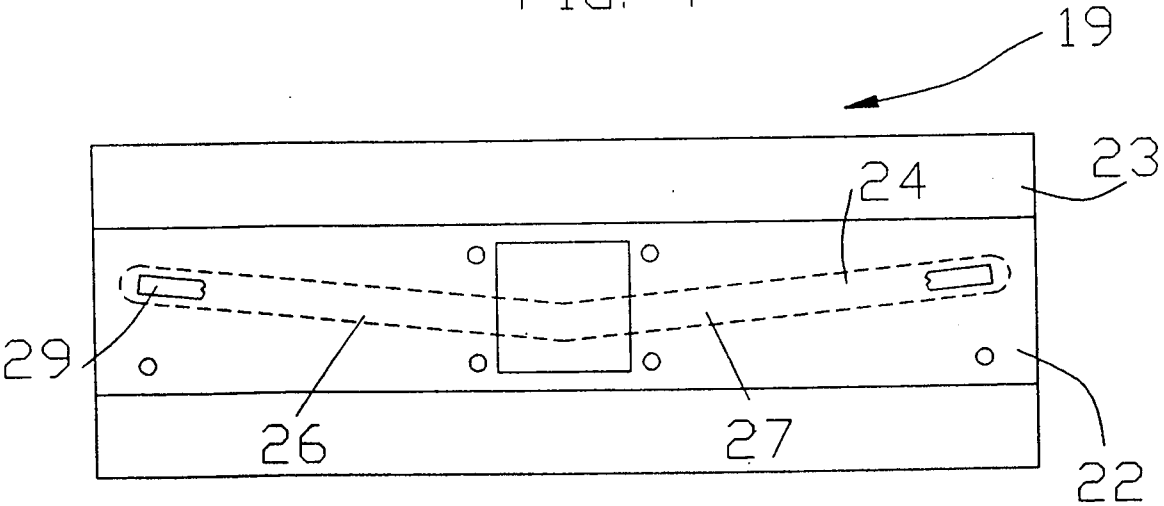
FIG. 3 is an enclosed view of the novel heat transfer assembly of FIG. 2, disclosing in phantom the closed passageway extending within the confines of the longitudinally extending thermally conductive plate to be brought to an isothermic condition.

The novel heat transfer assembly 18 of the present invention thermally and conductively communicating with the hot side 17 of thermo-electric module 14 includes a longitudinally extending conductive plate member 19 having one side face thereof in facing conductive contact with the hot side 17 of the thermo-electric module 14 and the opposite side face in facing thermally conductive contact with heat exchange unit 21. Advantageously, longitudinally extending plate member 19 can be of a suitable aluminum material having high thermally conductive qualities. It is to be understood that plate member 19 can be of a number of geometric configurations and sections conductively joined or it can be integrally formed. In the embodiment disclosed plate member 19 is formed of one integral thermally conductive longitudinally extending rectangular member of two stepped sections 22 and 23 which are coincident in length, but different in breadth and thickness with step section 22 being of smaller breadth than step section 23, the stepped sections 22 and 23 serve to include a longitudinally extending, fully enclosed recess or passageway 24 therein. This passageway 24 advantageously is configured to provide two subpassages 26 and 27 which longitudinally extend upwardly from a lower communicating centrally disposed apex portion upwardly and outwardly to subtend an angle of at least approximately one hundred and seventy degrees (170°) and advantageously an angle of approximately one hundred and sixty-five degrees (165°). The recess itself, since it is closed at the extremities thereof, can serve to create a heat pipe effect or it can incorporate a commercially available sealed thermally conductive heat pipe 29 therein of similar configuration but of lesser diameter than the recess. Heat pipe 29 is arranged to include a preselected small quantity of vaporizable and condensible fluid medium which advantageously can be noncorrosive, purified water maintained at a preselected temperature relative to ambient to be evaporated and condensed in the heat pipe 29 so as to uniformly and adiabatically transfer heat from the hot side 17 of the thermoelectric module 14 to the small section 22 and the large section 23 of the integral, longitudinally extending conductive plate member 19 to bring plate member 19 to an isothermic condition so as to isothermically conduct heat. Since the heat pipe functions effectively with a low differential temperature by using latent heat through evaporation and condensation of the fluid in a fully enclosed environment, this serves to lessen the differential temperature experienced by thermoelectric module 14, thus increasing the heat pumping capacity of module 14 and requiring comparatively less energy input. The heat of plate member 19 is conducted to the open-end, flow-through housing 31 of heat exchange unit 21 conductively fastened to the other side of the large section 23 of thermally conductive plate member 19. Flow-through housing 31 also can be of a thermally conductive material, such as aluminum. Flow-through housing 31 advantageously can include a heat exchange barrier comprised of at least one tier of thermally conductive v-shape pleated fin members 32 which can be of aluminum foil. Pleated fin members 32 are so positioned in flow-through arrangement in open-end flow-through housing 31 to allow heat conducted thereby to be transferred to an ambient air stream directed to flow through housing 31 as indicated in FIG. 5 by the flow arrows. It is to be understood that in accordance with one embodiment of the present invention temperatures on the hot side of thermoelectric module can reach as high as approximately 100° F. and the pressure within heat pipe 29 can be preselected accordingly. It further is to be understood that the cold and hot side of the thermoelectric module structure disclosed can be utilized in reverse to apply heat to the liquid receptacle 2 through hot side 17 of thermoelectric module 14 with temperatures on the cold side 16 being at approximately 34° F. and the pressure within heat pipe 29 being preselected accordingly. It further is to be understood that various configurations can be utilized for passageway 24, including spaced parallel passageways and subpassageways with the communication apex portion above the subpassageways. Further, if the configuration of the passageway or sub-passageways warrant, heat pipe wicks and wick linings can be employed, as deemed warranted.

Thus, in accordance with the present invention a unique heat transfer method for heat transfer is provided including the steps of regulating heat in a first thermally conductive zone, transferring the heat from the first thermally conductive zone to a second thermally conductive zone through alternative expansion and condensation of a preselected medium such as water in an enclosed thermally conductive passageway maintained at a preselected pressure to uniformly and adiabatically transfer the heat to the second thermally conductive zone to bring the second zone into an isothermic condition, and then transferring the heat from the isothermic zone to a third conductive zone.

From the above, it can be seen that a unique compact and efficient heat transfer assembly and method for regulating heat in a liquid storage receptacle is provided. The inventive arrangement provides for straightforward manufacture and assembly with a minimum of parts and a minimum of steps, requiring a comparatively minimum of energy in operation.

The invention claimed is:

1. A liquid storage receptacle for a liquid purification system comprising:

liquid plenum storage means adapted to receive and store liquids therein, said liquid plenum storage means having a first thermally conductive plate member extending substantially along a side thereof;

thermoelectric module means including two different electrical conductors to provide hot and cold sides with one side thereof thermally cooperative with a localized minor portion of the area of said first thermally conductive plate member for said plenum to regulate the temperature of liquid stored in said liquid plenum storage means; and, a heat transfer means cooperative with the other side of said thermoelectric module means, said heat transfer means including a second longitudinally extending thermally conductive planar surface having an substantially enclosed extended passage conductively cooperative between opposed faces of said second thermally conductive surface intermediate the longitudinal edges of said planar surface, said enclosed extended passage including a fluid medium disposed therein at a preselected pressure to be alternately vaporized and condensed to uniformly and adiabatically transfer the heat from a localized intermediate area between the extremities of said enclosed extended passage along said passage from the other side of said thermoelectrical module to and along said thermally conductive surface to bring it to an isothermic condition; and, a heat exchange means having a heat exchange barrier cooperative with said isothermic temperature conductive surface to transfer the heat on one side of the heat exchange barrier to the other side of said barrier.

2. The liquid storage receptacle of claim 1, said liquid plenum storage means being adapted to receive and store purified liquids from said purification system.

3. The liquid storage receptacle of claim 1, the one side of said thermoelectric module means cooperative with said liquid plenum storage means being the cool side and the other side being the hot side with at least a portion of said fluid medium in said enclosed passage being in liquid form at said preselected pressure in said enclosed passage.

4. The liquid storage receptacle of claim 1, the one side of said thermoelectric module means cooperative with said liquid plenum storage means being the hot side and the other side being the cold side with at least a portion of said fluid medium in said enclosed passage being in vapor form at said preselected pressure in said enclosed passage.

5. The liquid storage receptacle of claim 1, said fluid medium being purified water.

6. The liquid storage receptacle of claim 1, at least one of said thermally conductive surfaces being aluminum.

7. The liquid storage receptacle of claim 1, said liquid plenum storage means having said first thermally conductive plate member extending therethrough and therebeyond to provide the conductive surface for said heat transfer means.

8. The liquid storage receptacle of claim 1, said enclosed extended passage including a fluid medium conducting wick.

9. The liquid storage receptacle of claim 1, said first thermally conductive surface being in the form of an extended heat conductive metal plate.

10. The liquid storage receptacle of claim 1, said second thermally conductive surface having a recess therein for said enclosed extended passage.

11. The liquid storage receptacle of claim 1, said second thermally conductive surface having a longitudinally extending recess therein to receive an enclosed fluid medium containing heat pipe.

12. The liquid storage receptacle of claim 1, said second thermally conductive surface having a longitudinally extending recess therein closed at opposite ends thereof to form said enclosed passage to contain said fluid medium.

13. The liquid storage receptacle of claim 12, said recess being in the form of a V-shaped longitudinally extending passageway to include an apex portion comprising said localized intermediate area between the extremities of said enclosed extended passage and two communicating sub-passageways extending therefrom.

14. The liquid storage receptacle of claim 13, said apex portion of said V-shaped passageway being above said outwardly extending sub-passageways which extend downwardly thereform.

15. The liquid storage receptacle of claim 13, said apex portion of said V-shaped passageway being below said outwardly extending sub-passageways which extend upwardly therefrom.

16. A liquid storage receptacle for a liquid purification system comprising:

a liquid storage receptacle having at least one insulated liquid receiving plenum with a thermally conductive metal plate member with a first portion of said plate member below and in thermal relation with said liquid receiving plenum and a second portion turned to provide a second thermally conductive surface extending longitudinally along one side of said liquid receiving plenum;

a thermoelectric module including two different electrical conductors to provide hot and cold sides with one side thereof conductively connected in facing contact with a localized minor portion of the area of said second portion of said plate member to vary the temperature of said liquid plenum through said first and second portions of said plate member therebelow and therealong; and, a heat transfer assembly including a longitudinally extending conductive planar plate member having opposed faces with one face in facing conductive contact with one side of said thermoelectric module and the opposite face in facing conductive contact with a heat exchange unit, said longitudinally extending conductive plate member including a longitudinally extending recess substantially enclosed therein between said faces intermediate the longitudinally edges thereof and configured to provide two sub-passages longitudinally extending outwardly from a lower communicating centrally disposed apex portion upwardly to subtend an angle of approximately one hundred sixty-five degrees (165° ), said recess incorporating a sealed thermally conductive heat pipe therein of similar configuration which includes a preselected quantity of purified water at a preselected pressure relative to ambient to be evaporated and condensed in said heat pipe to uniformly and adiabatically transfer heat from a localized intermediate area between the extremities of said extended passage along said subpassages from said thermoelectric module to said longitudinally conductive plate member to bring said plate member in isothermic condition; said isothermic plate member having a flow-through heat exchanger housing conductively fastened to the other face thereof, said housing including at least one tier of thermally conductive fin members pleated in flow-through arrangement to pass heat conducted thereby to an ambient air flow directed thereover.

17. A heat transfer assembly cooperative with a planar first surface comprising:

a heat transfer means cooperative with said first surface to control the heat of said first surface, said heat transfer means including a second planar surface in the form of a plate with opposed faces, one of which thermally communicates with said first surface, said plate having a substantially enclosed longitudinally extended passage cooperative therewith extending between opposed faces thereof intermediate the longitudinal edges thereof, said enclosed extended passage including a fluid medium disposed therein at a preselected pressure to be capable of alternatively vaporizing and condensing to uniformly and adiabatically efficiently transfer the heat from said first surface to a localized area intermediate the extremities of said extended passage in said second surface and along said passage toward said extremities to bring said second surface into an isothermic condition.

18. The heat transfer assembly of claim 17, and a heat exchanger including a heat exchange barrier cooperative with said isothermic second conductive surface to transfer heat from one side of said barrier to the other side.

19. The heat transfer assembly of claim 17, said heat transfer being accomplished through heat conductive surfaces.

20. The heat transfer assembly of claim 17, at least a portion of said fluid medium in said enclosed passage being in liquid form at said preselected pressure in said enclosed passage.

21. The heat transfer assembly of claim 17, at least a portion of said fluid medium in said enclosed passage being in vapor form at said preselected pressure in said enclosed passage.

22. The heat transfer assembly of claim 17, said fluid medium being purified water.

23. The heat transfer assembly of claim 17, said heat exchange barrier including at least one aluminum strip configured in spaced V-shape folds to allow flow-through of a heat transfer medium.

24. The heat transfer assembly of claim 17, said second conductive surface having a recess therein for said enclosed extended passage.

25. The heat transfer assembly of claim 17, said second conductive surface including a longitudinally extending recess closed at opposed extremities to provide said enclosed passage containing said fluid medium.

26. The heat transfer assembly of claim 17, said second conductive surface including a longitudinally extending recess therein to receive an enclosed fluid medium containing pipe.

27. The heat transfer assembly of claim 17, and a thermoelectric module means including two different electrical conductors to provide hot and cold sides with one side thereof thermally cooperative with said first surface and the other cooperative with said second surface of said heat transfer means.

28. The heat transfer assembly of claim 24, said recess being in the form of a V-shaped passageway to include two preselected angle defining sub-passages communicating at the apex portion thereof forming said localized area intermediate said extremities.

29. The heat transfer assembly of claim 28, said apex portion being above said sub-passage extending downwardly and outwardly therefrom.

30. The heat transfer assembly of claim 28, said apex portion being below said sub-passages which extend downwardly and outwardly therefrom.

31. A heat transfer method comprising; regulating temperature in a first thermally conductive planar platelike zone; transferring heat between said first conductive planar platelike zone and a second thermally conductive planar platelike zone through alternative expansion and condensation of a preselected medium in a substantially enclosed thermally passageway centrally disposed intermediate the longitudinal extremities of said second planar platelike zone and maintained at a preselected pressure through a localized area centrally and immediately disposed intermediate the extremities of said narrow passageway and along said passageway toward said passageway extremities to uniformly and adiabatically transfer the heat to said second zone to bring said second zone into an isothermic condition; and transferring the heat from said isothermic second zone to a third zone to be heated.

32. The heat transfer method of claim 31 said heat being transferred conductively.

33. The heat transfer method of claim 31, said preselected medium being purified water.

34. The heat transfer method of claim 31, said pressure in said enclosed narrow passageway being selected in accordance with the temperatures exchange at said heat exchange zone.

35. The heat transfer method of claim 31, said enclosed narrow passageway being tortuously configured to optimize heat transfer to said second zone.

36. The heat transfer method of claim 31, wherein said temperature in said first thermally conductive zone is regulated through a junction of two unlike metals through which an electric current is passed.

* * * * *

UNITED STATES PATENT AND TRADEMARK OFFICE

CERTIFICATE OF CORRECTION

PATENT NO. : 5,174,121

DATED : 12-29-92

INVENTOR(S) : Steven L. Miller

It is certified that error appears in the above-identified patent and that said Letters Patent is hereby corrected as shown below:

Column 8, line 42:
In claim 31, line 7, the words -- conductive narrow -- have been ommited by the Patent Office between "thermally" and "passageway".

Signed and Sealed this

Second Day of November, 1993

*Attest:*

Bruce Lehman

BRUCE LEHMAN

*Attesting Officer*

*Commissioner of Patents and Trademarks*